United States Patent [19]

Lee

[11] Patent Number: 4,706,944

[45] Date of Patent: Nov. 17, 1987

[54] STOPPER FOR USE IN MOLTEN METAL HANDLING

[75] Inventor: Stephen J. Lee, Clydebank, Scotland

[73] Assignee: Thor Ceramics Limited, Clydebank, Scotland

[21] Appl. No.: 827,931

[22] PCT Filed: May 7, 1985

[86] PCT No.: PCT/GB85/00188

§ 371 Date: Feb. 10, 1986

§ 102(e) Date: Feb. 10, 1986

[87] PCT Pub. No.: WO85/05056

PCT Pub. Date: Nov. 21, 1985

[30] Foreign Application Priority Data

May 5, 1984 [GB] United Kingdom ..... 8411596

[51] Int. Cl.[4] ..... C21C 5/48

[52] U.S. Cl. ..... 266/272; 222/597; 222/603

[58] Field of Search ..... 266/271, 272, 217, 220, 266/224, 287; 222/597, 603

[56] References Cited

U.S. PATENT DOCUMENTS

| | | | |
|---|---|---|---|
| 3,084,038 | 4/1963 | Finkl | 266/217 |
| 3,200,457 | 8/1965 | Wagstaff | 266/217 |
| 3,214,804 | 11/1965 | Saccomano | 266/217 |

FOREIGN PATENT DOCUMENTS

| | | | |
|---|---|---|---|
| 0106822 | 4/1984 | European Pat. Off. . | |
| 0148425 | 11/1981 | Japan | 222/603 |
| 2095612 | 10/1982 | United Kingdom | 222/597 |

*Primary Examiner*—L. Dewayne Rutledge
*Assistant Examiner*—S. Kastler
*Attorney, Agent, or Firm*—Gerald J. Ferguson, Jr.; Michael P. Hoffman; Michael J. Foycik, Jr.

[57] ABSTRACT

A stopper comprising a monoblock refractory body having a gas duct formed longitudinally within the body wherein the said duct extends through the nose of the stopper to an intermediate region within the length of the stopper at which region the duct is sealed by a gas-impermeable plug to prevent gas leakage from the duct through the stopper beyond said region, and wherein said duct and an integral narrow gas supply channel extending from said port to a gas supply inlet on the outside surface of the stopper adjacent the opposite end of the stopper from the nose.

10 Claims, 6 Drawing Figures

STOPPER FOR USE IN MOLTEN METAL HANDLING

This invention relates to a stopper used in the control of flow of molten metal through a submerged entry nozzle (SEN), as for example in the pouring of molten steel from a Tundish.

It is common practice now to provide a stopper with means for injecting an inert gas through the stopper nose into the nozzle to prevent fouling of the nozzle by deposition of Alumina or other non-metallic oxides. The way this is normally done is to make the stopper with a through-bore formed longitudinally within the stopper which converges at the nose to provide a narrow gas injection nozzle. This type of stopper has a gas supply line fastened to the upper end of the through bore which then acts as a gas duct to convey inert gas to the stopper nose. However due to the relatively complex mountings and fittings attached to the upper end of such a stopper, there are a large number of joints through which the inert gas can escape. In view of the temperatures of operation all the joints are dry-sealed i.e. close fitting ceramic/metal joints possibly including special gaskets but without sealing compounds. However these joints are never perfect and gas losses are inevitable.

Inert gas is an expensive material and losses through joints in the system demand use of large volumes of gas to ensure sufficient gas is delivered into the throat of the nozzle to provide a beneficial effect which increases costs to a level which is no longer acceptable to the industry.

The use of high gas volumes to overcome gas losses also introduces a potential variability in mould turbulence effects which can adversely affect cast metal quality.

Further study of this system has revealed, that in use molten metal pouring through the SEN creates a venturi effect in the throat of the nozzle which has been observed to cause a vacuum of down to about 15 torr in the throughbore of the stopper. This vacuum draws in air from the surroundings through any imperfections in the joints of the stopper assembly and argon supply system which defeats the purpose of introducing argon in the first instance by introducing air into the inert gas stream thus contaminating the melt.

An object of the present invention is to obviate or mitigate the aforesaid disadvantages.

According to the present invention there is provided a stopper which comprises a monoblock refractory body having a gas duct formed longitudinally within the body and extending from the nose of the stopper to an intermediate level within the length of the stopper body at which level the duct is sealed apart from a gas supply port opening from a narrow gas supply channel extending to a gas supply inlet on the outside surface of the stopper adjacent to the opposite end of the stopper from the nose.

Preferably the said gas supply channel is formed by co-pressing into the stopper during its manufacture a tubular member formed from a gas-impermeable material e.g. a steel tube.

Preferably also the said gas supply channel is formed to include a region of restricted gas flow. This may be achieved by including in the channel restrictor means for restricting gas flow through the conduit. In the case of a steel tube this may be so formed as to include a portion of reduced internal diameter. The reduction in internal diameter may be obtained simply by deforming the tube wall or by including a restrictor ring or similar partial barrier to gas flow within the tube. Although these stoppers still operate with vacuum conditions at the stopper nose which are transmitted down the argon supply line (potential source of air ingress) the introduction of a small restriction creates a positive pressure in the supply line as a safeguard against leaks of air into this supply system.

This has the surprising advantage of being able to not only reduce argon supply flow rates to about 1–4 l/min whilst maintaining the flushing efficiency with respect of reduced Alumina build up and/or reduced nitgrogen contamination risk, but also lessens mould turbulence observed previously when using much higher argon flow rates in an effort to exclude air from the system. This reduction in mould turbulence can lead to improved surface quality and macro cleanliness of the ingots blooms or slabs.

Further the stopper according to this invention has improved casting times significantly with times of 5 hours now being common and occasionally as long as 8½ hours compared to previous performance of 2–4 hours, due to a reduction in SEN blockage by prevention of Alumina build up in the bore.

This stopper has also the advantage that there is only a single joint of small dimensions in the gas supply system, namely at the gas supply inlet, where any loss of gas or air ingress is possible so that the risk of leakage is minimised.

The invention will now be described further by way of the following example with reference to the accompanying drawings in which.

EXAMPLE 1

Figure 2:
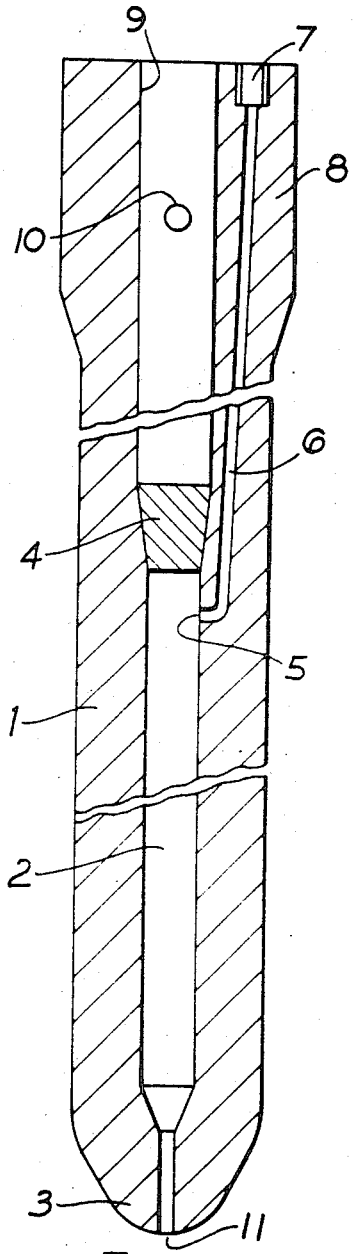
FIGS. 2–6 show stoppers of this invention in each of which equivalent parts have been given the same identifying numeral.

A stopper for use in the control of melt flow in molten metal handling operations (referring to FIG. 2) comprises a refractory body (1) of the monoblock type having a gas duct (2) formed longitudinally within the body (1) and extending from the nose (3) of the stopper to an intermediate level within the length of the stopper body (1) at which level the duct (2) is sealed by a plug (4) apart from a small gas supply port (5) opening from a narrow gas supply channel (6) extending through the body (1) of the stopper to a gas supply inlet (7) adjacent the opposite end (8) of the stopper from the nose (3).

A cavity (9) in the end (8) is used to locate a conventional mounting (10) which is used for supporting the stopper in use.

In this particular embodiment the stopper has a pointed nose (3) to improve metal flow and a single gas injection port (11) but in alternative embodiments a multi-port or a gas permeable nose could be used.

Figure 1:
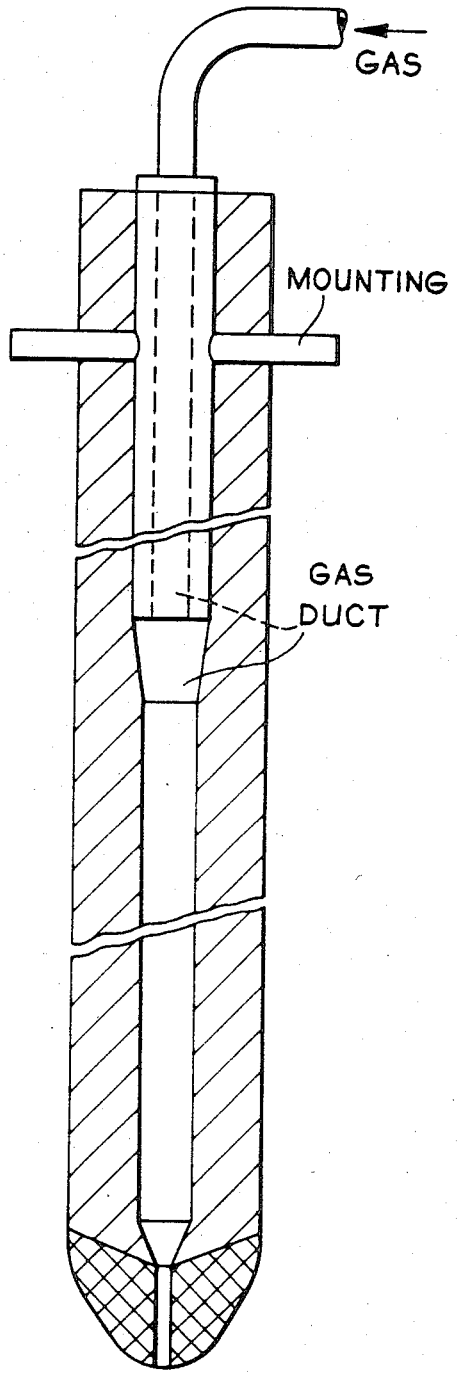
Fig. 1 (PRIOR ART)
FIG. 1 shows a stopper forming part of the known art.

In use a gas supply line is coupled to the inlet (7) which being remote from and unconnected with the cavity (9) where the mounting (10) is located means that there is no possibility of gas loss between the stopper and the mounting as in the known stopper shown in FIG. 1.

In addition because of the position of the gas duct (2) and gas supply port (5) the gas is brought in a sealed system to below the melt level so that gas loss and air ingress is further minimised.

Preliminary tests have shown gas-flow rates into the SEN can be controlled more easily and that considerable savings in inert gas are possible.

EXAMPLE 2

Figure 3:
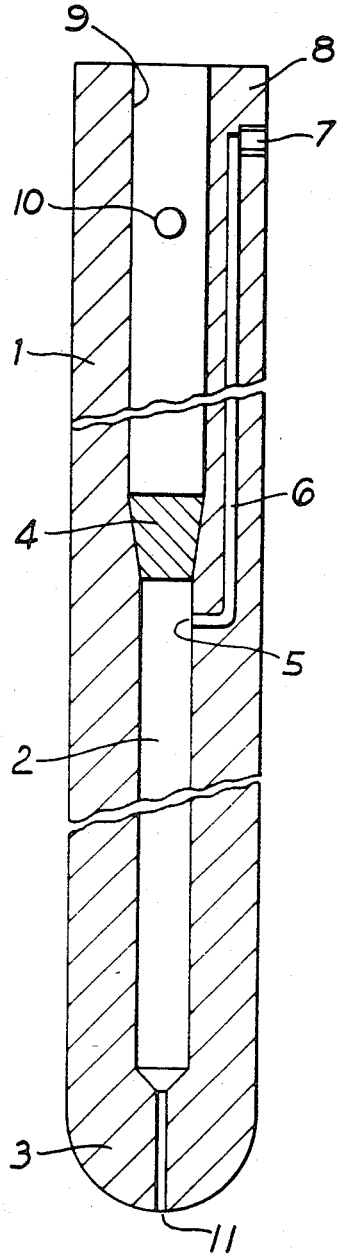

A stopper for use in the control of melt flow in molten metal handling operations (referring to FIG. 3) comprises a refractory body (1) of the monoblock type having a gas duct (2) formed longitudinally within the body (1) and extending from the nose (3) of the stopper to an intermediate level within the length of the stopper body (1) at which level the duct (2) is sealed by a plug (4) apart from a small gas supply port (5) opening from a narrow gas supply channel (6) extending through the body (1) of the stopper to a gas supply inlet (7) adjacent the opposite end (8) of the stopper from the nose (3).

A cavity (9) in the end (8) is used to locate a conventional mounting (10) which is used for supporting the stopper in use.

Figure 4:
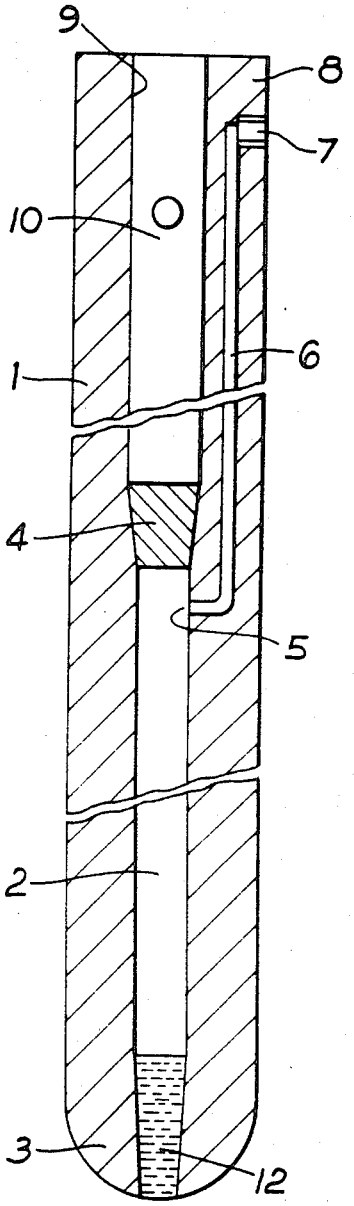

In this particular embodiment the stopper has a single gas injection nozzle (11) but in an alternative embodiment as shown in FIG. 4 a gas-permeable plug (12) is provided in the nose (3), The position of the gas supply inlet, 7, is at 90° to the stopper arms to allow a straight coupling pipe to be used to make the gas connection.

EXAMPLE 3

Figure 5:
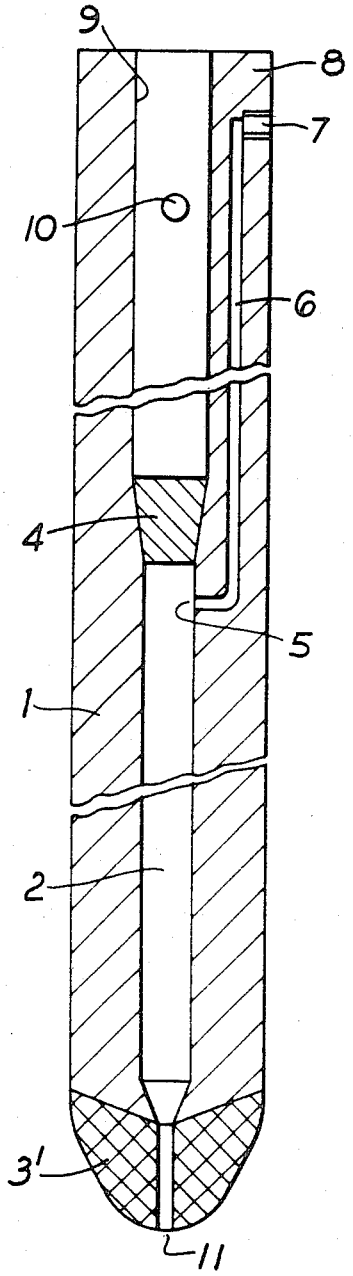

A stopper for use in the control of melt flow in molten metal handling operations (referring to FIG. 5) comprises a refractory body (1) of the monoblock type having a gas duct (2) formed longitudinally within the body (1) and extending from the nose (3') of the stopper to an intermediate level and within the length of the stopper body (1) at which level the duct (2) is sealed by a plug (4) apart from a small gas supply port (5) opening from a narrow gas supply channel (6) extending through the body (1) of the stopper to a gas supply inlet (7) adjacent the opposite end (8) of the stopper from the nose (3').

A cavity (9) in the end (8) is used to locate a conventional mounting (10) which is used for supporting the stopper in use.

In this particular embodiment the stopper has a pointed armoured nose (3') of higher refractory material to improve wear resistance with a single gas injection nozzle (11) but in alternative embodiments a gas-permeable nose or multi-nozzle nose could be used.

EXAMPLE 4

Figure 6:
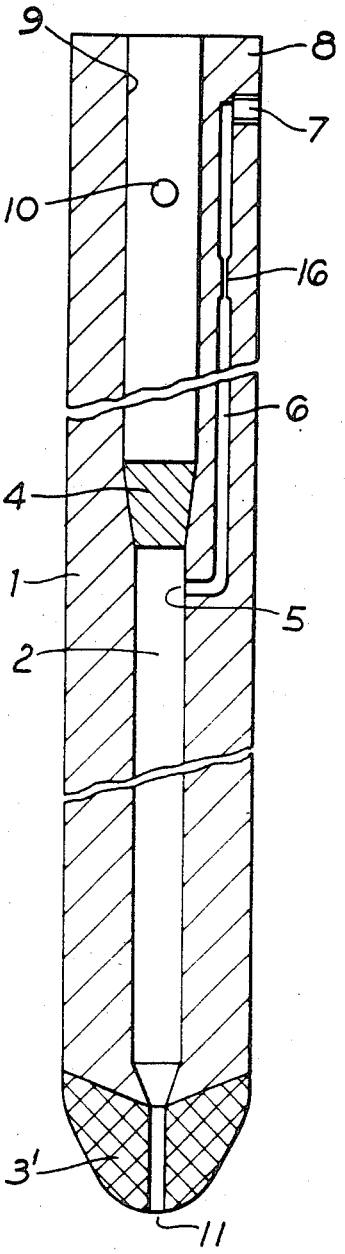

A stopper for use in the control of melt flow in molten metal handling operations (referring to FIG. 6) comprises a refractory body (1) of the monoblock type having a gas duct (2) formed longitudinally within the body (1) and extending from the nose (3) of the stopper to an intermediate level within the length of the stopper body (1) at which level the duct (2) is sealed by a plug (4) apart from a small gas supply port (5) opening from a narrow gas supply channel (6) extending through the body (1) of the stopper to a gas supply inlet (7) adjacent the opposite end (8) of the stopper from the nose (3).

The gas supply channel (6) is provided with gas flow restrictor means (16).

A cavity (9) in the end (8) is used to locate a conventional mounting (10) which is used for supporting the stopper in use.

In this particular embodiment the stopper has an armoured nose (3') of higher refractory material with a single gas injection nozzle (11) but in alternative embodiments a gas-permeable nose or multi-nozzle nose could be used.

Each of the stoppers shown in FIGS. 2–6 is used in substantially the same manner and a selection for use is made on the basis of the kind of melt being handled and the duration of the casting operation required.

The stoppers are ideally manufactured by an isostatic pressing method. Whereas the gas duct in each stopper illustrated is closed at its upper end by a gas impermeable plug, this is simply considered to be the easiest and most economic way of forming a closure for the duct.

Using this stopper it is possible to include an accurate flow rate and pressure control system in the inert gas supply line which was not possible previously due to the amount of leaks in the system.

The degree of restriction in the gas-supply channel is selected to match the intended operating conditions.

It is found that improved melt flow control and injection of inert gas with reduced deposition in the SEN is obtained if a pointed nose stopper is used.

I claim:

1. In a stopper comprising a monoblock refractory body having a gas duct extending longitudinally within the body of the stopper from one end in the opposite end, the said duct providing at said one end a means of injecting gas through an aperture in the nose of the stopper and at said opposite end means for receiving a stopper support member, the improvement comprising (a) the provision of a solid gas-tight plug within the duct to seal the duct at an intermediate level within the body of the stopper to thereby form a shortened gas duct at said one end and a socket at said opposite end for receiving the stopper support means, and (b) the provision of an integral narrow gas supply channel communicating with the shortened duct between the seal and the nose and extending from said shortened duct through the body of the stopper to a gas supply inlet provided at said opposite end.

2. A stopper according to claim 1, wherein said gas supply channel is formed by co-pressing into the stopper during its manufacture a tubular member formed from a gas-impermeable material.

3. A stopper according to claim 1, wherein said gas supply channel includes restrictor means.

4. A stopper according to claim 1, wherein said nose is formed from a higher refractory material, to provide a wear-resisting armored nose.

5. A stopper according to claim 1, wherein said nose is pointed.

6. A stopper comprising a monoblock refractory body having a gas duct formed longitudinally within the body wherein the said duct extends through the nose of the stopper to an intermediate region within the length of the stopper at which region the duct is sealed by a gas-impermeable plug to prevent gas leakage from the duct through the stopper beyond said region, and wherein said body is provided with a gas supply port adjacent said duct and an integral narrow gas supply channel extending from said port to a gas supply inlet on the outside surface of the stopper adjacent the opposite end of the stopper from the nose.

7. A stopper according to claim 6 wherein said gas supply channel is formed by co-pressing into the stopper during its manufacture a tubular member formed from a gas-impermeable material.

8. A stopper according to claim 6 wherein said gas supply channel includes restrictor means.

9. A stopper according to claim 6 wherein said nose is formed from a higher refractory material, to provide a wear-resisting armored nose.

10. A stopper according to claim 6 wherein said nose is pointed.

* * * * *